US006632035B1

(12) United States Patent
Kawamoto

(10) Patent No.: US 6,632,035 B1
(45) Date of Patent: Oct. 14, 2003

(54) PRINT CONTROL APPARATUS AND METHOD

(75) Inventor: Hirokazu Kawamoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 179 days.

(21) Appl. No.: 09/627,045

(22) Filed: Jul. 27, 2000

(30) Foreign Application Priority Data

Jul. 30, 1999 (JP) ..... 11-217854

(51) Int. Cl.[7] ..... B41J 11/44
(52) U.S. Cl. ..... 400/61; 400/70; 400/76
(58) Field of Search ..... 400/61, 70, 76

(56) References Cited

U.S. PATENT DOCUMENTS 5,699,494 A * 12/1997 Colbert et al. ..... 358/1.15
5,727,135 A * 3/1998 Webb et al. ..... 358/1.14
6,104,470 A * 8/2000 Streefkerk et al. ..... 355/40
6,330,542 B1 * 12/2001 Sevcik et al. ..... 705/400

FOREIGN PATENT DOCUMENTS

EP 0 331 329 A1 * 9/1989 ..... 364/521

* cited by examiner

*Primary Examiner*—Charles H. Nolan, Jr.
(74) *Attorney, Agent, or Firm*—Fitzpatrick, Cella, Harper & Scinto

(57) ABSTRACT

An information processing apparatus connected and capable of transmitting print data to a printing apparatus having a plurality of paper feeds. The information processing apparatus includes (i) means for acquiring information from the printing apparatus, (ii) means for determining whether a cover of a booklet can be printed by the printing apparatus, based on the information obtained by the acquiring means, (iii) means for enabling selection of one of a first paper feed containing cover sheets for printing the cover of the booklet, if the determining means determines that the cover of the booklet can be printed by the printing apparatus, and (iv) generating means for generating print data linked to the paper feeds.

39 Claims, 11 Drawing Sheets

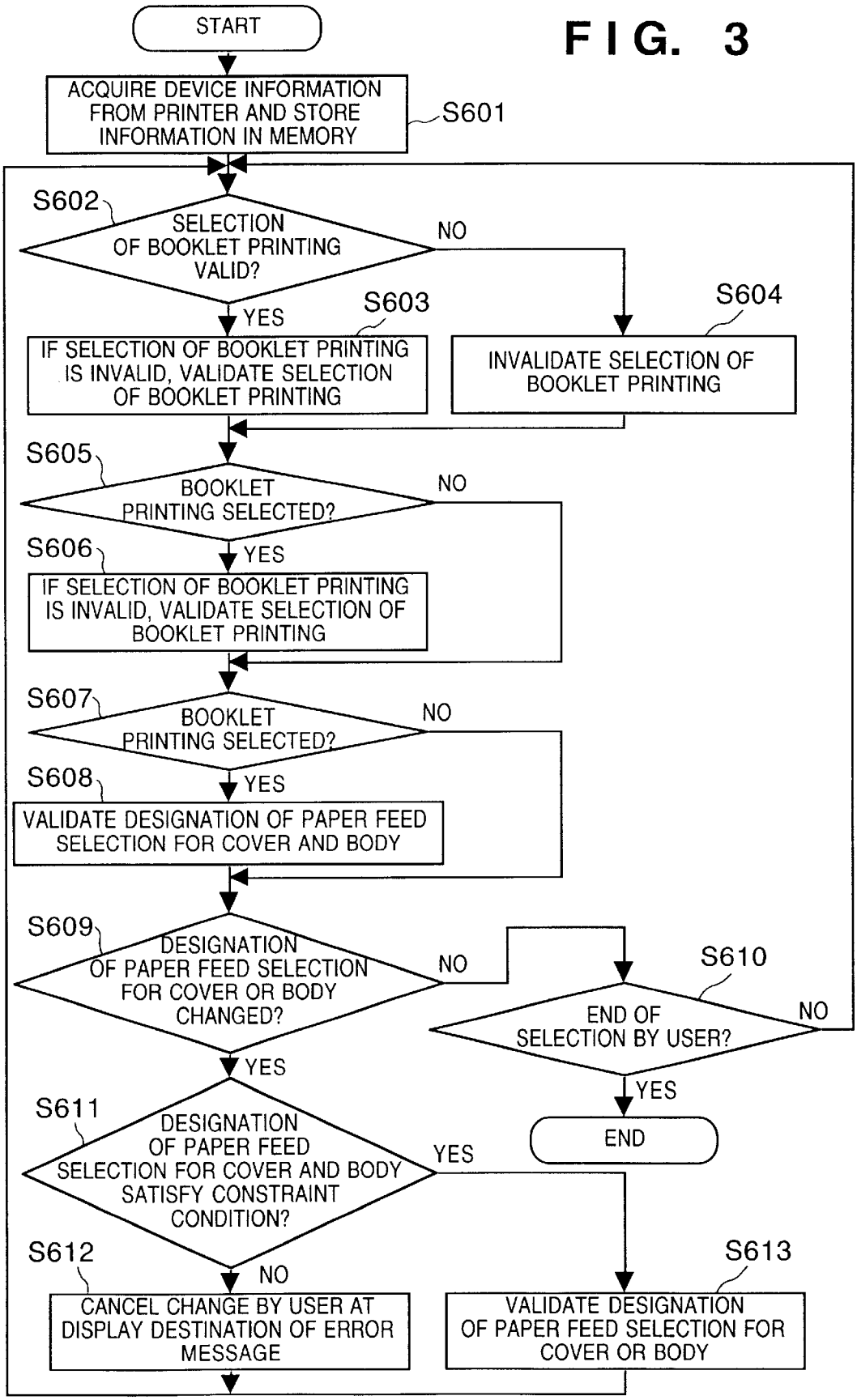
FIG. 3
START
ACQUIRE DEVICE INFORMATION FROM PRINTER AND STORE INFORMATION IN MEMORY
S601
S602
SELECTION OF BOOKLET PRINTING VALID?
NO
YES
S603
IF SELECTION OF BOOKLET PRINTING IS INVALID, VALIDATE SELECTION OF BOOKLET PRINTING
S604
INVALIDATE SELECTION OF BOOKLET PRINTING
S605
BOOKLET PRINTING SELECTED?
NO
YES
S606
IF SELECTION OF BOOKLET PRINTING IS INVALID, VALIDATE SELECTION OF BOOKLET PRINTING
S607
BOOKLET PRINTING SELECTED?
NO
YES
S608
VALIDATE DESIGNATION OF PAPER FEED SELECTION FOR COVER AND BODY
S609
DESIGNATION OF PAPER FEED SELECTION FOR COVER OR BODY CHANGED?
NO
YES
S610
END OF SELECTION BY USER?
NO
YES
END
S611
DESIGNATION OF PAPER FEED SELECTION FOR COVER AND BODY SATISFY CONSTRAINT CONDITION?
YES
NO
S612
CANCEL CHANGE BY USER AT DISPLAY DESTINATION OF ERROR MESSAGE
S613
VALIDATE DESIGNATION OF PAPER FEED SELECTION FOR COVER OR BODY

FIG. 7

Paper Selection :

- ○ Same Paper for All Pages
- ○ Different for First, Others, and Last
- ○ Different for First, Second, Others, and Last
- ⊙ Different for Cover and Others
- ○ Transparency Interleaving Cover Page : AUTO Other Pages : AUTO

FIG. 8

Paper Selection :

- ○ Same Paper for All Pages
- ○ Different for First, Others, and Last
- ○ Different for First, Second, Others, and Last
- ⊙ Different for Cover and Others
- ○ Transparency Interleaving Cover Page : AUTO Other Pages :

AUTO
Stack Bypass
Drawer 1
Drawer 2
Drawer 3
Drawer 4

FIG. 15

Paper Selection :

- ○ Same Paper for All Pages
- ○ Different for First, Others, and Last
- ○ Different for First, Second, Others, and Last
- ◉ Different for Cover and Others
- ○ Transparency Interleaving Cover Page : AUTO Other Pages : AUTO ☐ Printing on Cover Page ☐ Insert Other page into Back Page of Cover

PRINT CONTROL APPARATUS AND METHOD

FIELD OF THE INVENTION

The present invention relates to a print control apparatus and method for performing print control concerning booklet printing and, more particularly, to a print control apparatus and method for performing print control concerning booklet printing in a system constituted by an information processing apparatus such as a personal computer and an output apparatus such as a printer.

BACKGROUND OF THE INVENTION

With the development of recent computer technologies, the performance of computers have improved, and printing apparatuses are equipped with various functions under the control of the computer. As a function of the printing apparatus, a booklet printing function has become available.

When, however, booklet printing is designated by an application program running on a computer to execute printing, a conventional printing apparatus does not perform any special control for one booklet in booklet printing. For example, to print a booklet with a different type of paper (e.g., colored paper) for the cover from that for the body, the user must perform special operation.

For example, the user separately prints a cover and body, and binds them after printing. Alternatively, the user sets one cover paper sheet on the top of a printer cassette having body paper sheets, and immediately prints the cover and body at the same time.

In a case wherein the printer performs saddle stitch in booklet printing, the cover and body of a booklet must be stapled, so that the user must execute the latter operation.

SUMMARY OF THE INVENTION

The present invention has been made to overcome the conventional drawbacks, and has as its object to designate a paper feed selection for the cover of the booklet separately from the body, and enable printing out a booklet with a cover desired by the user without any cumbersome user operation.

It is another object of the present invention to provide a print control apparatus and method capable of automatically determining limitations caused by the hardware of the printing apparatus and limitations caused by designating different paper feed selections for the cover and body of a booklet to print the booklet, and explicitly indicating to the user whether or not booklet printing with a designated cover is possible.

It is still another object of the present invention to provide a print control apparatus and method capable of preparing a means for allowing the user to designate whether or not to print data on the cover and back pages of the cover of a booklet, and satisfying various booklet printing needs of the user.

To achieve the above objects, a print control apparatus capable of performing print control concerning booklet printing, comprises acquisition means for acquiring information for determining whether or not booklet cover printing is enabled, notifying means for notifying a user that booklet printing is disabled when booklet printing is disabled, determination means for determining whether or not a cover can be designated in booklet printing on the basis of the information acquired by the acquisition means, and setting means for setting a paper feed selection for a cover of a booklet by the user separately from other pages.

To achieve the above objects, the print control apparatus further comprises cover printing designation means for designating by the user whether or not to print data on the cover of the booklet, or back page printing designation means for designating by the user whether or not to print data on a back page of the cover of the booklet.

To achieve the above objects, a print control apparatus for performing print control concerning booklet printing, comprises means for determining whether or not a cover can be designated in booklet printing on the basis of information for determining whether or not acquired booklet cover printing is enabled, when booklet printing is disabled, notifying a user that booklet printing is disabled, and allowing the user to set a paper feed selection for a cover of a booklet separately from other pages.

To achieve the above objects, a print control method in a print control apparatus for performing print control concerning booklet printing, comprises the step of designating a paper feed selection for a cover of a booklet separately from a body, and enabling printing out the booklet with a cover desired by an operator.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 3 is a flowchart showing booklet printing setting processing according to the first embodiment;

FIG. 7 shows a display window example when a booklet cover printing function is selected in the first embodiment;

FIG. 8 is for explaining designation of a paper feed selection for the cover on the display window shown in FIG. 7 according to the first embodiment;

FIG. 15 shows a display example of a selection window for setting whether or not to print data on the cover and back pages of the cover in booklet printing according to the second embodiment.

DETAILED DESCRIPTION OF THE PREFERRED EMBODIMENTS

Preferred embodiments of the present invention will be described in detail below with reference to the accompanying drawings. Unless otherwise specified, the present invention can be applied to a single device, a system constituted by a plurality of devices, or a system which performs processing while being connected via a network such as a LAN or WAN as far as the functions of the present invention are executed.

[First Embodiment]

Figure 1:
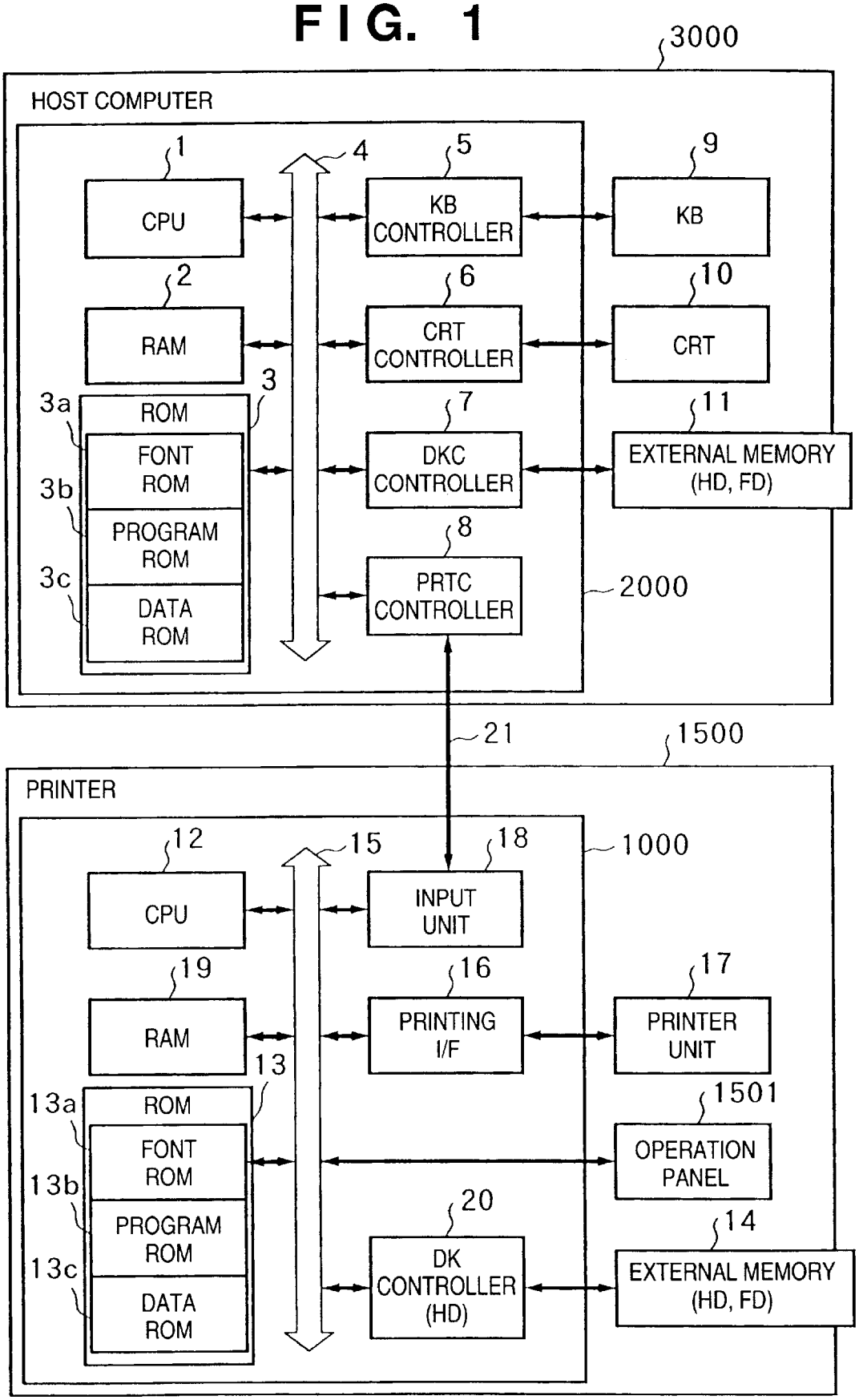
FIG. 1 is a block diagram for explaining the arrangement of a printer control system according to the first embodiment of the present invention.

FIG. 1 is a block diagram for explaining the arrangement of a printer control system according to the first embodiment of the present invention.

In FIG. 1, reference numeral 1500 denotes a printer; and 3000, a host computer.

The printer 1500 and host computer 3000 are connected via a predetermined bidirectional interface (interface) 21.

The host computer 3000 comprises a CPU 1 for executing document processing for figures, images, characters, and tables (including spreadsheets and the like) based on a document processing program stored in an internal program ROM 3*b* of a ROM 3 or an external memory 11. The CPU 1 integrally controls devices connected to a system bus 4.

The program ROM 3*b* of the ROM 3 or the external memory 11 stores an operating system program (to be referred to as an "OS" hereinafter) serving as the control program of the CPU 1. A font ROM 3*a* of the ROM 3 or the external memory 11 stores font data and the like used in document processing. A data ROM 3*c* of the ROM 3 or the external memory 11 stores various data used in document processing or the like.

Reference numeral 2 denotes a RAM functioning as a main memory, work area, and the like for the CPU 1; 5, a keyboard controller (KBC) for controlling a key input from a keyboard 9 or a pointing device (not shown); and 6, a CRT controller (CRTC) for controlling the display on a CRT display (CRT) 10.

Reference numeral 7 denotes a disk controller (DKC) for controlling access to the external memory 11 for storing a boot program, various application programs, font data, user files, edit files, a printer control command generation program (to be referred to as a "printer driver" hereinafter), and the like. The external memory 11 includes a hard disk drive (HD) and floppy disk drive (FD) as standard equipment. The external memory 11 can be expanded by various storage devices such as an IC card, magnetooptical disk (MO), and CD-ROM drive.

Reference numeral 8 denotes a printer controller (PRTC) connected to the printer 1500 via the bidirectional interface 21 to execute communication control processing with the printer 1500.

The CPU 1 executes, e.g., mapping (rasterizing) processing of an outline font to a display information RAM (not shown) set on the RAM 2, and enables WYSIWYG on the CRT display 10. The CPU 1 opens various registered windows and executes various data processes on the basis of commands designated with a mouse cursor (not shown) on the CRT display 10.

In executing printing, the user can open a window concerning settings of printing to set a printer and a printing processing method for the printer driver including selection of the printing mode.

In the printer 1500, reference numeral 12 denotes a printer CPU for outputting an image signal as output information to a printer unit (printer engine) 17 connected to a system bus 15 on the basis of a control program stored in a program ROM 13*b* of a ROM 13 or a control program stored in an external memory 14.

The program ROM 13*b* of the ROM 13 stores the control program of the CPU 12. A font ROM 13*a* stores font data used in generating output information. For a printer not having any external memory 14 such as a hard disk, a data ROM 13*c* stores information used on the host computer. The CPU 12 can communicate with the host computer via an input unit 18 to notify the host computer 3000 of internal information of the printer.

Reference numeral 19 denotes a RAM which functions as a main memory, work area, and the like for the CPU 12, and can expand the memory capacity by an optional RAM connected to an expansion port (not shown). The RAM 19 is used as an output information mapping area, environment data storage area, NVRAM, and the like. The external memory 14 such as a hard disk (HDD) or IC card is access-controlled by a memory controller (MC) 20.

The external memory 14 is connected as an option, and stores font data, emulation programs, form data, and the like. Reference numeral 1501 denotes an operation panel having operation switches, LED indicators, and the like. Note that the external memory is not limited to one, and a plurality of external memories can be used. A plurality of external memories can be connected which include an optional font card in addition to a standard font card, and store programs for interpreting the printer control languages of different language systems.

Further, the printer 1500 may use an NVRAM to store printer mode setting information from the operation panel 1501.

Figure 2:
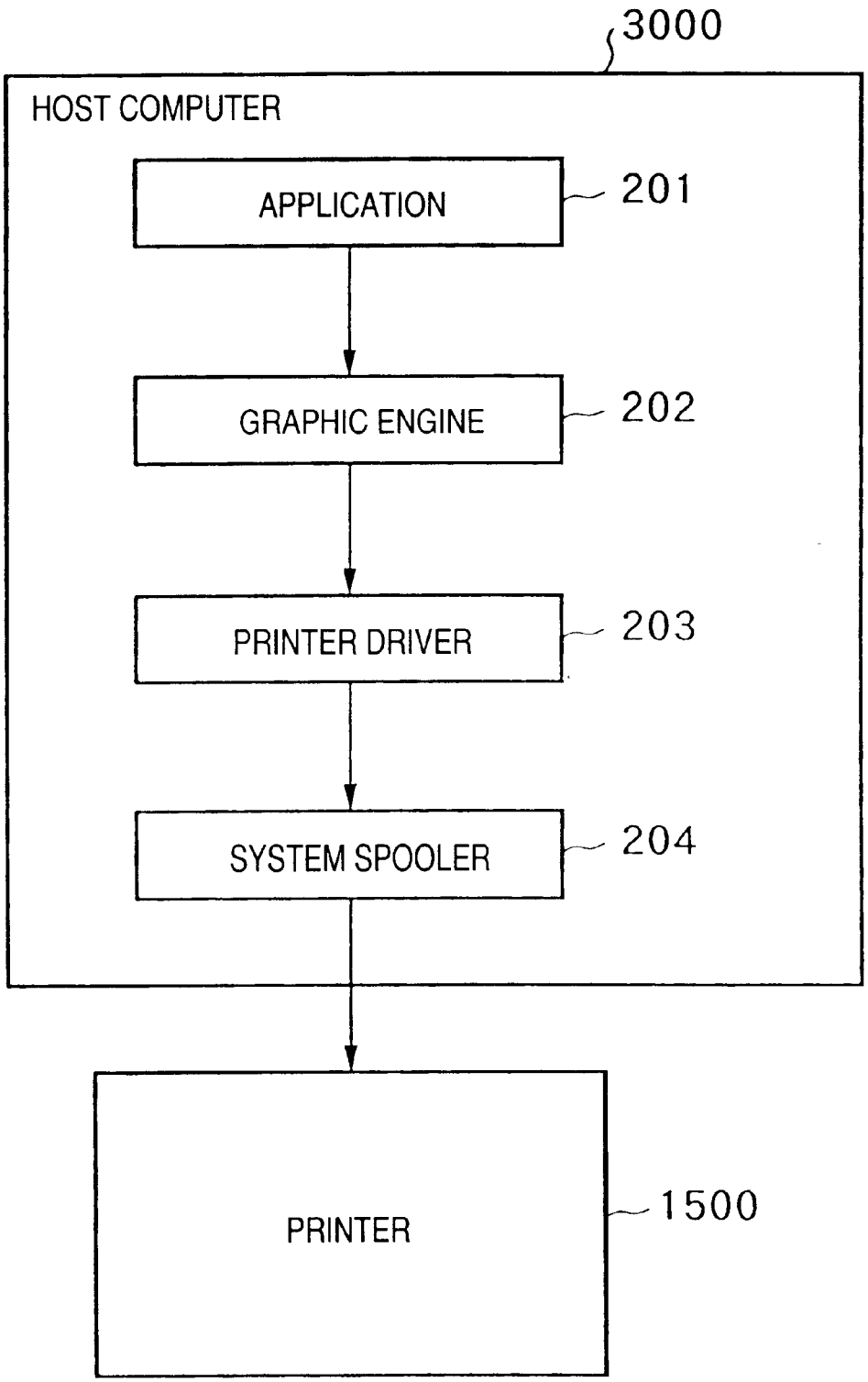
FIG. 2 is a block diagram showing typical printing processing in a host computer according to the first embodiment.

FIG. 2 is a block diagram showing typical printing processes in the host computer connected to a printing apparatus such as a printer directly or via a network. In FIG. 2, an application program 201, graphic engine 202, printer driver 203, and system spooler 204 are program modules existing as files stored in the external memory 11. In execution, these files (program modules) are loaded to the RAM 2 by an OS or modules using these modules.

The application 201 and printer driver 203 can be loaded from the FD or CD-ROM of the external memory 11 or via a network (not shown) and additionally stored in the HD of the external memory 11.

The application 201 stored in the external memory 11 is loaded to the RAM 2 and then executed. In print data from the application 201 by the printer 1500, data is output (drawn) using the graphic engine 202 which is similarly loaded to the RAM 2 and becomes executable.

The graphic engine 202 similarly loads the printer driver 203 prepared for each printing apparatus from the external memory 11 to the RAM 2, and converts an output from the application 201 into a printer control command using the printer driver 203. The converted printer control command is output to the printer 1500 via the system spooler 204 loaded to the RAM 2 and the interface 21.

Booklet print control in the first embodiment having this arrangement will be explained with reference to the flowcharts of FIGS. 3 to 5.

Booklet printing processing in the first embodiment having the above arrangement is done under the management of an OS (Operating Systems). The user operates the keyboard controller (KBC) 5 shown in FIG. 1 to load to the RAM 2 the application program 201 for performing booklet printing processing shown in, e.g., FIGS. 3 to 5, and activate the application program 201. Booklet print control starts by designating a destination printer and instructing execution of printing using the activated and running application program 201.

Figure 6:
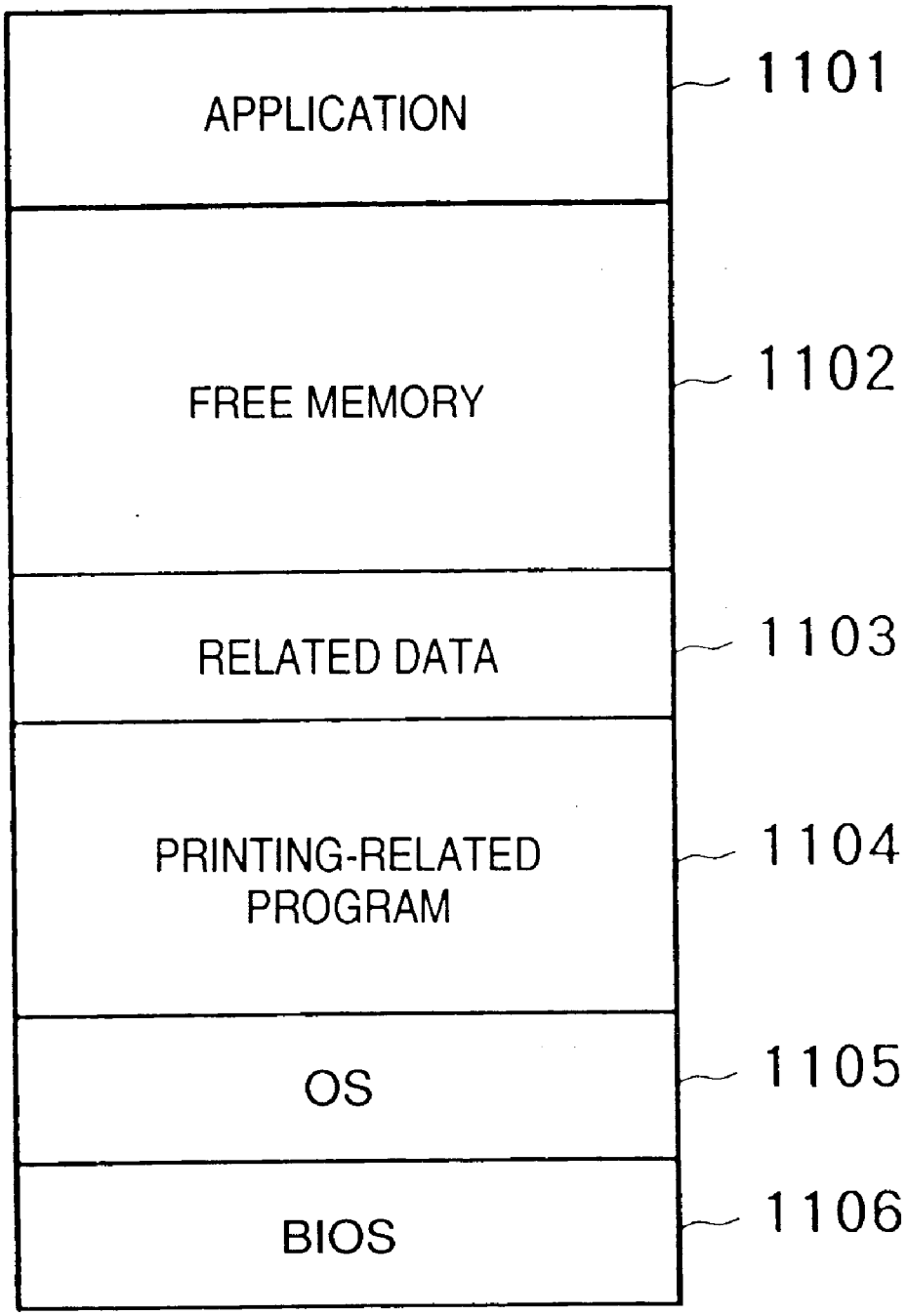
FIG. 6 shows a memory map when a printing program in the first embodiment becomes executable after being loaded to the RAM of the host computer.

An example of the storage state of programs in the RAM area in executing booklet printing processing in the first embodiment is shown in FIG. 6. FIG. 6 is a view showing a memory map when a printing program in the first embodiment becomes executable after being loaded to the RAM 2 in the host computer 3000.

In FIG. 6, reference numeral 1101 denotes an application program storage area; 1102, a free area of the memory; 1103, a related data storage area necessary for processing; 1104, a printing-related program storage area; 1105, an OS storage area; and 1106, a BIOS storage area. The print control program in this embodiment exists as part of the printing-related program 1104.

Figure 4:
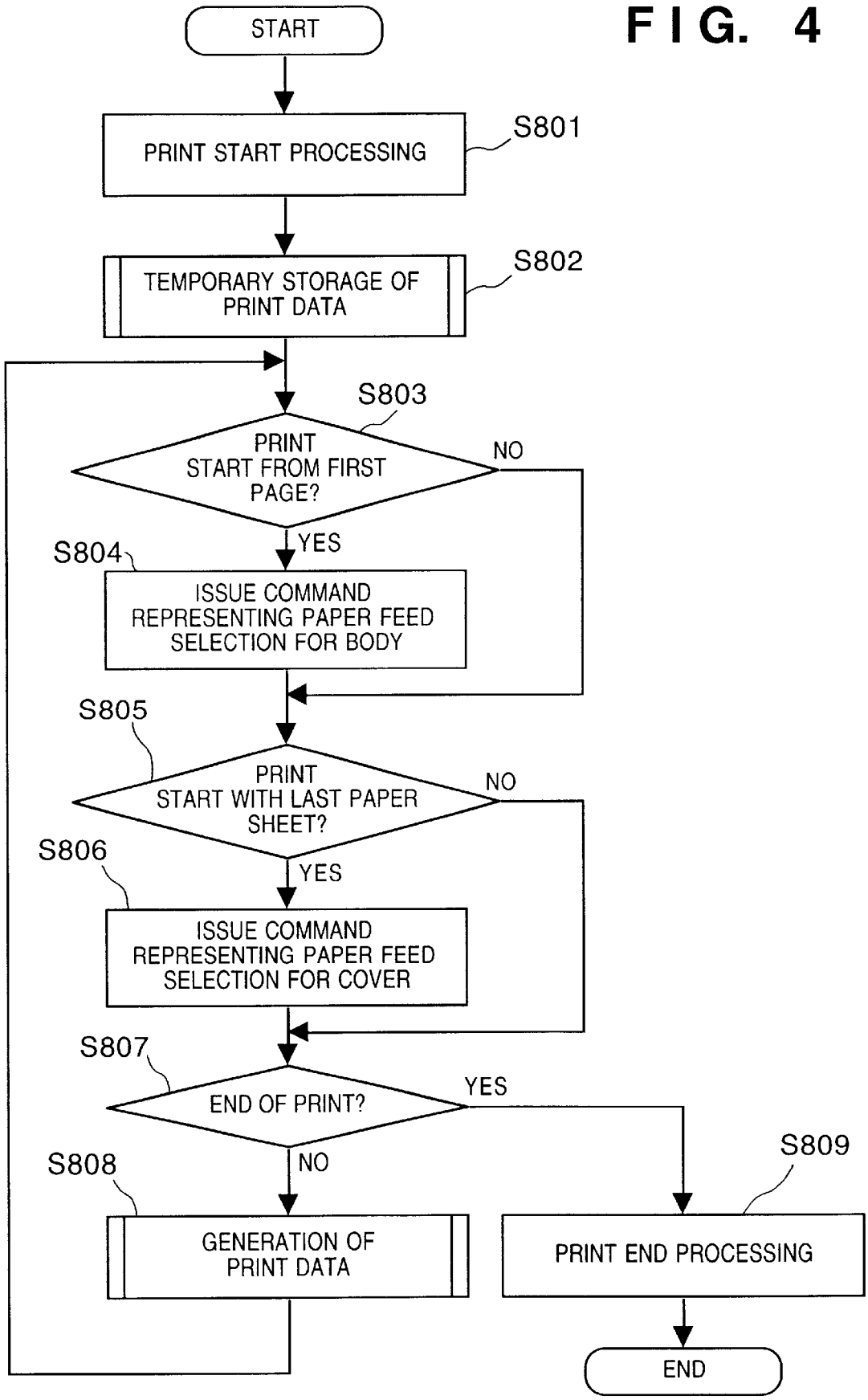
FIG. 4 is a flowchart showing booklet printing execution processing according to the first embodiment.

As shown in the flowcharts of FIGS. 3 and 4, the processing in the first embodiment is roughly divided into two, booklet printing setting processing and booklet printing processing. Booklet printing setting processing in this embodiment will be described with reference to the flowchart of FIG. 3.

In step S601, the printing-related program 1104 running on the host computer 3000 requests the printer 1500 to transmit booklet printing-related information, and acquires the booklet printing-related information of the printer 1500.

The information acquisition method depends on the connection method between the host computer and the printer. If the host computer and printer are connected via a parallel interface (e.g., interface having centronics interface specifications), information is acquired via a bidirectional interface (e.g., bidirectional I/F such as Nibble or ECP). If the host computer and printer are connected via a network, e.g., the host computer accesses an MIB mounted on the printer via the SNMP.

In this embodiment, the information acquisition means is not limited so long as necessary information can be acquired. Detailed information acquired from the printer 1500 includes information shown in Table 1 necessary for determining whether or not booklet printing is enabled and whether or not booklet cover printing is enabled.

For example, the acquired information includes "2-sided printing?" and "the attribute of each paper feed port (paper size and convey direction)".

TABLE 1

| | | |
|---|---|---|
| Booklet Cover Printing Enabled? | Prerequisite | Booklet printing must be enabled. Paper size capable of 2-sided printing must be selected as printing paper. |
| | Constraint condition | Among information of the paper size set in the paper feed port selected as a paper feed selection, the paper size and paper convey direction of the cover must be identical to that of the body. |
| Information Acquired from Printer | 2-sided printing enabled/disabled? | Used to determine whether or not booklet printing is enabled. |
| | Attribute of each paper feed port (used to determine whether or not booklet cover printing is enabled). | Paper size and convey direction. |

Information acquired in step S601 is not limited to the those shown in Table 1, and may appropriately change in accordance with the characteristics of the printer. In some cases, new items may be added. For example, if the printer cannot perform booklet printing for a specific type of paper, the type of paper (plain paper, OHP, or thick paper) can be added to the acquired information, and used to determine whether or not booklet printing is enabled. Information acquired from the printer is temporarily stored in the free memory 1102 shown in FIG. 6.

Processing in the following flowchart is serial processing for an input from the user, and all processes are not executed along this flowchart. After one input processing is done, the processing returns to step S602 and continues until the user performs all selection processes.

Figure 12:
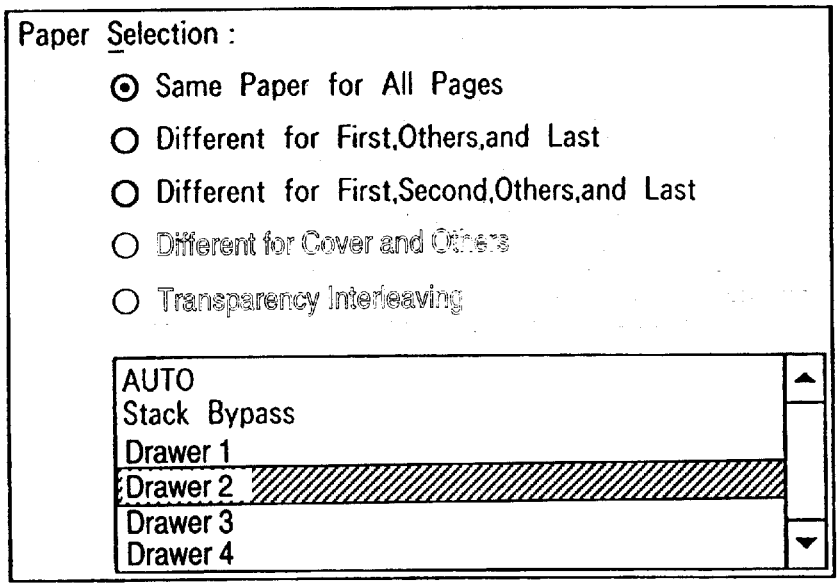
FIG. 12 shows a display example of a setting window shifted when booklet printing is validated in booklet printing according to the first embodiment.

FIGS. 7 to 10 show display examples of the paper feed selection setting window in booklet printing according to the first embodiment. For example, if the user selects a booklet cover printing function "Different for Cover and Others" from a state in which "Same Paper for All Pages" shown in FIG. 12 is selected, the display of the setting window switches to a display window shown in FIG. 7.

The display window in FIG. 7 allows designating a paper feed selection for the cover or body. To designate a paper feed selection for the cover or body on the window in FIG. 7, a desired paper feed selection is designated from a pull-down menu, as shown in FIG. 8. In the example of FIG. 8, "Drawer 1" is designated.

Figure 9:
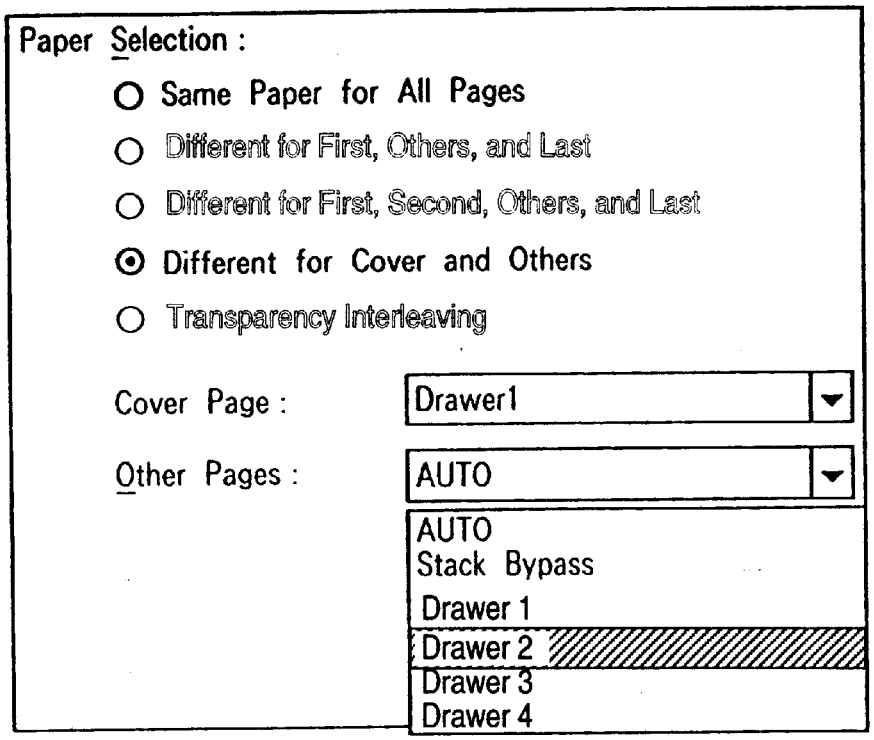
FIG. 9 is for explaining designation of a paper feed selection for the body on the display window shown in FIG. 7 according to the first embodiment.

As shown in FIG. 9, a desired paper feed selection for "Other Pages" as the body is designated from a pull-down display, similarly to FIG. 8. In the example of FIG. 9, "Drawer 2" is designated.

Figure 10:
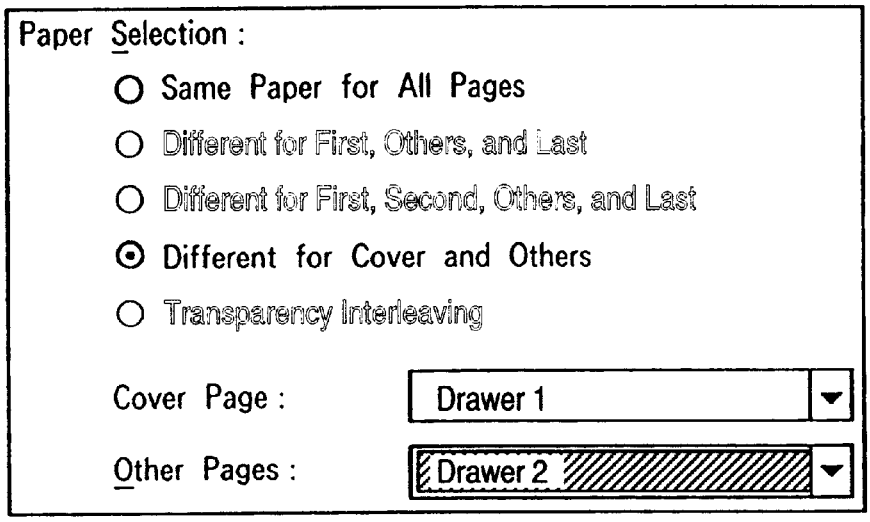
FIG. 10 shows a display window example after the paper feed selection is set in the first embodiment.

A display window upon completion of settings is shown in FIG. 10. The user confirms the settings on this display, and if the settings are proper, setting processing ends. This setting processing will be explained in detail.

If the paper feed selection for the cover or body is changed as shown in FIG. 8 or 9, the processing shifts to step S611. In FIG. 8 or 9, controls "Cover Page" and "Other Pages" for the cover and body are used to select these functions.

In step S602, the printing-related program 1104 determines whether or not booklet printing processing can be selected, based on 2-sided printing enable/disable information acquired in step S601. If YES in step S602, the processing shifts to step S603 to validate selection of booklet printing, and to step S605.

Figure 11:
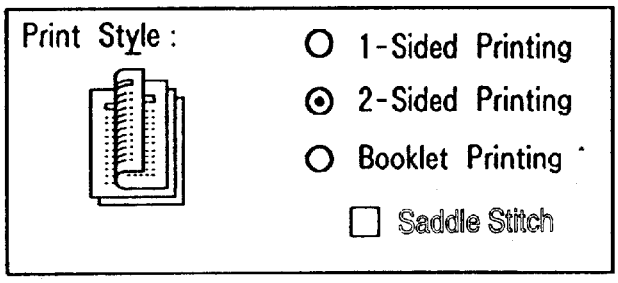
FIG. 11 shows a display example of a selection window for 1-sided printing/2-sided printing/booklet printing in booklet printing according to the first embodiment.

If NO in step S602, the flow shifts to step S604 to invalidate selection of booklet printing (control not to perform selection processing of booklet printing). Then, the processing advances to step S605. An example of a selection window for selection/non-selection of booklet printing is not shown. For example, selection of a control "Booklet Printing" shown in FIG. 11 is validated in processing of step S603, and invalidated in processing of step S604.

Figure 13:
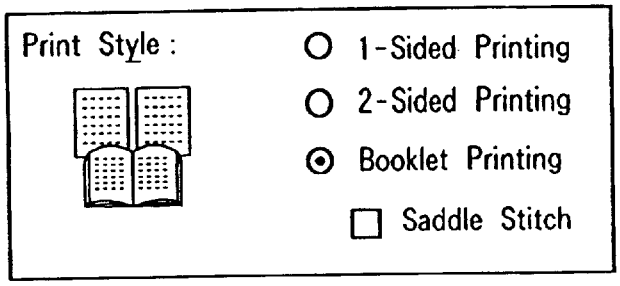
FIG. 13 is a view showing a display example of a selection window for instructing printing by the booklet function in booklet printing according to the first embodiment.

In step S605, whether or not booklet printing is selected is determined. If NO in step S605, the processing shifts to step S607. If YES in step S605, the flow shifts to step S606 to validate selection of booklet cover printing, and then to step S607. For example, when "2-Sided Printing" shown in FIG. 11 is selected, the booklet cover printing function "Different for Cover and Others" shown in FIG. 12 cannot be selected. However, if the booklet printing function "Booklet Printing" is selected, as shown in FIG. 13, the control "Different for Cover and Others" shown in FIG. 7 can be selected.

In step S607, whether or not booklet cover printing is selected is checked. If NO in step S607, the processing advances to step S609. If YES in step S607, the processing advances to step S608 to validate designation of paper feed selections for the cover and body, and then to step S609. If the user selects the booklet cover printing function "Different for Cover and Others" from a state in which "Same Paper for All Pages" shown in FIG. 12 is selected, as described above, the display window switches to the one shown in FIG. 7, allowing designating a paper feed selection for the cover or body.

In step S609, whether or not a paper feed selection for the cover or body is designated (changed) is checked. If NO in step S609, the processing shifts to step S610 to determine whether or not selection by the user ends. If YES in step S610, the setting window is closed to end booklet printing setting processing.

If NO in step S610, the processing returns to step S602 to continue booklet printing setting processing.

If YES in step S609, and the setting of a paper feed selection for the cover or body is changed as shown in FIG. 8 or 9, the processing advances to step S611. In FIG. 8 or 9, the controls "Cover Page" and "Other Pages" for the cover and body are used to select these functions.

In step S611, it is checked whether or not the paper feed selection for the cover or body designated (changed) in step S609 satisfies constraint conditions of booklet cover printing. The determination method in step S611 is based on the paper size and paper convey direction as constraint conditions used in the first embodiment shown in Table 1.

In step S610, the attributes of paper feed ports selected by paper feed selections for the cover and body (information temporarily stored in the free memory 1102 in step S601) are compared. For example, when Drawer 1 (paper feed attribute: A4-size paper, lateral convey direction) and Drawer 2 (paper feed attribute: A4-size paper, longitudinal convey direction) are respectively selected for the cover and body, the paper sizes are the same, but the convey directions are different. Thus, booklet cover printing cannot be executed.

Figure 14:
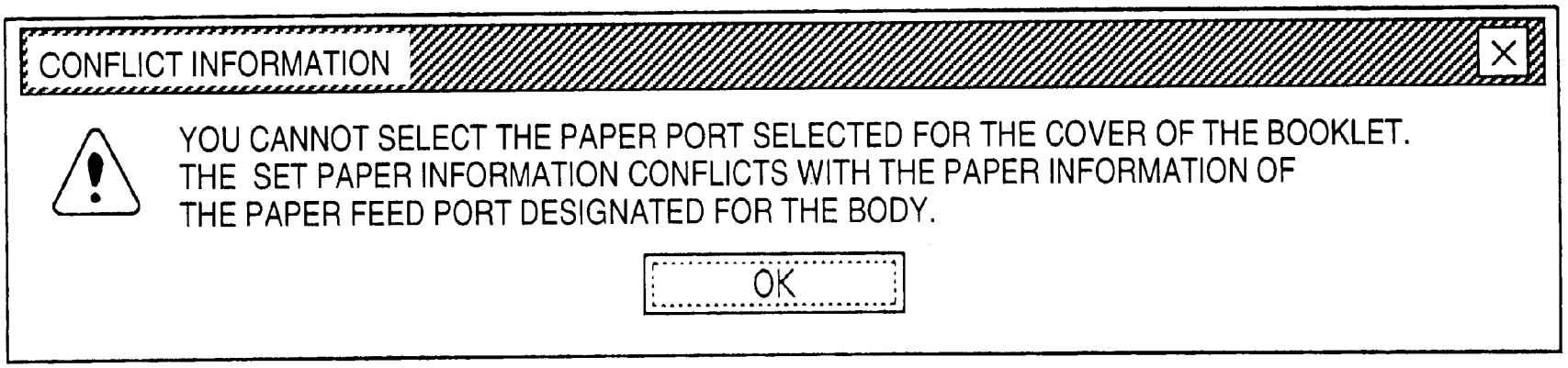
FIG. 14 shows an example of a message notifying the user that booklet cover printing is invalid in the first embodiment.

If NO in step S611, the processing shifts to step S612 to display an error message, as shown in FIG. 14, and the changed user settings are reset to the previous ones. Then, the processing shifts to step S602.

If YES in step S611, and booklet cover printing is properly set, the flow advances to step S613 to validate designation of a paper feed selection for the cover or body, and to step S602.

After selection processing by the user ends, and the user instructs execution of printing, booklet cover printing is done along the flow shown in FIG. 4. Booklet printing setting processing in the first embodiment will be described with reference to FIG. 4.

FIG. 4 shows an example in which the setting method of a paper feed selection in booklet printing according to the first embodiment can be set. FIGS. 10 to 13 show display examples of the display window for enabling setting of the paper feed selection in booklet printing in booklet printing setting processing in executing processing of FIG. 4.

FIG. 11 shows a display example of a selection window for 1-sided printing/2-sided printing/booklet printing. FIG. 12 shows a display example of a setting window shifted when booklet printing is validated. FIG. 13 shows an example of instructing printing by the printing function.

In step S801 shown in FIG. 4, print start processing is performed. The contents of print start processing are preparations for step S802. In step S802, print data from the application program is temporarily stored in units of pages in a predetermined format. The data is kept stored in units of pages until printing from the application ends. In step S802, data is temporarily stored in units of pages, while page rearrangement processing necessary for booklet printing is done.

Although not shown in this embodiment, a table holds temporary file names for storing each page data, and the entry order of file names is adjusted to an order matching booklet printing.

For example, when the application instructs booklet printing of 8-page data, an actual printout page order is 4, 5, 3, 6, 2, 7, 1, and 8. This page order is adopted when the host computer controls the page order in booklet printing. When the printer controls the page order, processing in this step need not be performed.

In step S803, whether or not print starts from the first page is checked. If NO in step S803, the processing shifts to step S805.

If YES in step S803, the processing shifts to step S804 to issue a printing command representing a paper feed selection for the body and output the command to the printer 1500. Then, the processing advances to step S805.

In step S805, whether or not print starts with the last paper sheet is determined. As the determination method, when, e.g., 8-page data are to be so printed as to include printing even on the cover and back pages of the cover, a change page number for the paper feed selection of the cover is temporarily stored in the memory 1102 during page rearrangement processing in step S802. Then, this number is compared in step S805 with a page number for which processing is to start. For 8-page data, the fifth page (i.e., second page as print data from the application) meets this condition.

If YES in step S805, the processing shifts to step S806 to issue a command representing a paper feed selection for the cover, and then to step S807. If NO in step S805, the processing shifts to step S807.

In step S807, whether or not printing ends is checked. If YES in step S805 and NO in step S807, the processing shifts to step S808 to perform print data generation processing (step S808), and returns to step S803. If YES in step S807, printing end processing is done to end the processing. After that, print data is transmitted to the printer 1500 via the system spooler 204 shown in FIG. 2, and printed by the printer.

In the description of step S802, the case in which the printer 1500 controls the page order in booklet printing has been exemplified. Alternatively, when the printer 1500 has the above-mentioned booklet printing function, processes in steps S803 to S806 may be done only by issuing a booklet printing command. As a matter of course, the booklet printing command used in this case must use a format which allows separately designating paper feed selections for the cover and body.

After the above processing, the whole printing processing from the application ends. As a result, the processing of the printing program in the first embodiment also ends, and the OS 405 functions to delete data from the RAM 2. In this embodiment, the medium on which the printing program is recorded is an external memory. This medium may be a flexible disk (FD), hard disk (HD) drive, CD-ROM, IC memory card, or the like. The printing program only or together with another program running on the host computer can be recorded on the ROM 3, and constituted as part of the memory map so as to be directly executed by the CPU 1.

As described above, the first embodiment can designate a paper feed selection for the cover of a booklet separately from the body, and print out a booklet with a cover desired by the user without any cumbersome user operation. Further, the first embodiment can automatically determine limitations caused by the hardware of the printing apparatus and limitations caused by designating different paper feed selections for the cover and body of a booklet to print the booklet, and explicitly indicate to the user whether or not booklet printing with a designated cover is possible.

[Second Embodiment]

The first embodiment always performs printing processing on cover and back pages without controlling whether or not to print data on the cover and back page of the cover. Alternatively, a display window shown in FIG. 15 may be prepared, and a control (cover page: Printing on Cover Page, back page: Insert Other page into Back Page of Cover) for setting on this display window whether or not to print data on the cover and back pages of the cover may be employed to enable the control in executing booklet printing.

The second embodiment adopting this control according to the present invention will be described with reference to FIG. 5.

Figure 5:
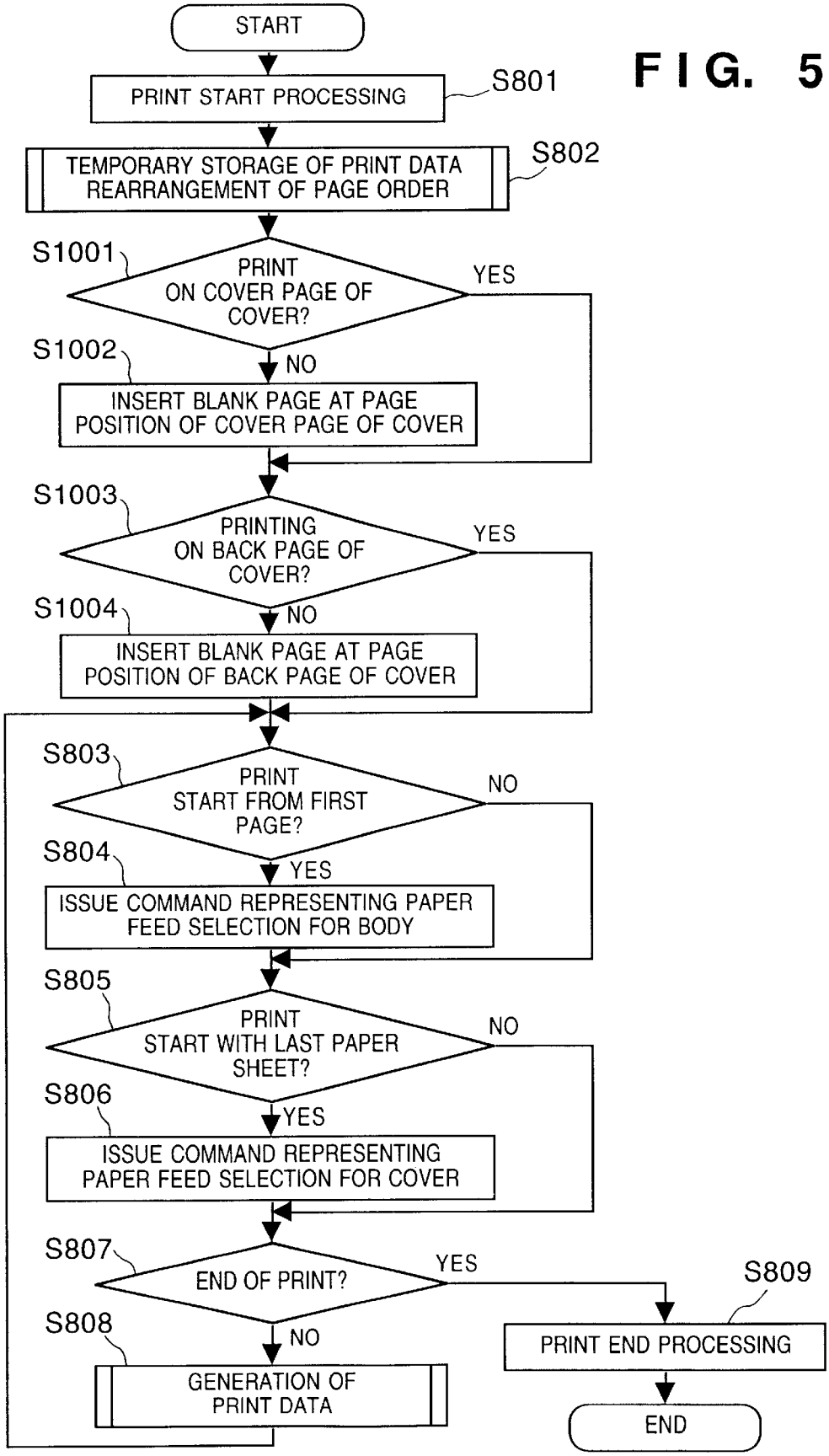
FIG. 5 is a flowchart showing booklet printing execution processing according to the second embodiment of the present invention.

FIG. 5 is a flowchart showing booklet printing execution processing according to the second embodiment of the present invention. In FIG. 5, the same step numerals as in booklet printing execution processing shown in FIG. 4 in the first embodiment denote the same steps, and a detailed description of the processing will be omitted.

In the second embodiment shown in FIG. 5, processes in steps S1001 to S1004 are inserted between steps S802 and S803 of the flowchart shown in FIG. 4. These steps execute print control on cover and back pages in booklet printing processing.

In the second embodiment, the processing shifts from step S802 to step S1001. In step S1001, it is determined whether or not printing on the cover page of the cover is designated. If YES in step S1001, i.e., "Printing on Cover Page" in FIG. 15 is "checked", the processing advances to step S1003.

If NO in step S1001, and "Printing on Cover Page" in FIG. 15 is "not checked", the processing advances to step S1002 to insert a blank page at the position of print data to be printed on the cover page of the cover. This is because when print data is comprised of 8 pages, like the first embodiment, blank page data are generated before the first page and after the last page to process the 8-page data as a total of 10-page data. Thereafter, the processing shifts to step S1003.

In step S1003, it is determined whether or not printing on the back page of the cover is designated. If YES in step S1003, i.e., "Insert Other page into Back Page of Cover" in FIG. 15 is checked, the processing shifts to step S803 and subsequent steps.

If NO in step S1003, the processing shifts to step S1004 to insert a blank page at the position of print data to be printed on the back page of the cover. This is because when print data is comprised of 8 pages, like the first embodiment, blank page data are generated before the first page and after the last page.

If the number of pages exceeds, e.g., the maximum number of saddle stitch enable pages by the device owing to insertion of a blank page, the number of pages is separately adjusted.

Hence, the number of pages subjected to booklet printing processing is processed as a total of 10-page data when printing on the back page of the cover is designated, and as a total of 12-page data when printing on the back page of the cover is not designated. After this processing ends, the processing shifts to step S803 and subsequent steps.

Processes in step S803 and subsequent steps are the same as in the first embodiment shown in FIG. 4, and a detailed description thereof will be omitted.

As described above, the second embodiment can control whether or not to print data on the cover and back pages of the cover, in addition to the effects of the first embodiment.

[Other Embodiment]

The present invention may be applied to a system constituted by a plurality of devices (e.g., a host computer, interface device, reader, and printer) or an apparatus comprising a single device (e.g., a copying machine or facsimile apparatus).

The object of the present invention is realized even by supplying a storage medium storing software program codes for realizing the functions of the above-described embodiments to a system or apparatus, and causing the computer (or a CPU or MPU) of the system or apparatus to read out and execute the program codes stored in the storage medium.

In this case, the program codes read out from the storage medium realize the functions of the above-described embodiments by themselves, and the storage medium storing the program codes constitutes the present invention.

As a storage medium for supplying the program codes, a floppy disk, hard disk, optical disk, magnetooptical disk, CD-ROM, CD-R, magnetic tape, nonvolatile memory card, ROM, or the like can be used.

The functions of the above-described embodiments are realized not only when the readout program codes are executed by the computer but also when the OS (Operating System) running on the computer performs part or all of actual processing on the basis of the instructions of the program codes.

The functions of the above-described embodiments are also realized when the program codes read out from the storage medium are written in the memory of a function expansion board inserted into the computer or a function expansion unit connected to the computer, and the CPU of the function expansion board or function expansion unit performs part or all of actual processing on the basis of the instructions of the program codes.

When the present invention is applied to the above storage medium, the storage medium stores program codes corresponding to the above-described flowcharts.

As has been described above, the present invention can designate a paper feed selection for the cover of a booklet separately from the body, and print out a booklet with a cover desired by the user without any cumbersome user operation. The present invention can automatically determine limitations caused by the hardware of the printing apparatus and limitations caused by designating different paper feed selections for the cover and body of a booklet to print the booklet, and explicitly indicate to the user whether or not booklet printing with a designated cover is possible. Moreover, the present invention can prepare a means for allowing the user to designate whether or not to print data on the cover and back pages of the cover of a booklet, and satisfy various booklet printing needs of the user.

As many apparently widely different embodiments of the present invention can be made without departing from the spirit and scope thereof, it is to be understood that the invention is not limited to the specific embodiments thereof except as defined in the appended claims.

What is claimed is:

1. An information processing apparatus connected and capable of transmitting print data to a printing apparatus having a plurality of paper feeds, the information processing apparatus comprising:

acquiring means for acquiring information from the printing apparatus;

determining means for determining whether a cover of a booklet can be printed by the printing apparatus, based on the information obtained by the acquiring means;

selection enabling means for enabling selection of one of a first paper feed containing page sheets for printing a desired text thereon and a second paper feed containing cover sheets for printing the cover of the booklet if the determining means determines that the cover of the booklet can be printed by the printing apparatus; and generating means for generating print data linked to the paper feeds.

2. The information processing apparatus according to claim 1, wherein the selection enabling means further enables selection of whether to print at least one of a front surface of the cover and a back surface of the cover.

3. The information processing apparatus according to claim 2, further comprising blank page generating means for generating a blank page in lieu of printing the print data of at least one of the front surface of the cover and the back surface of the cover if at least one of the front surface of the cover and the back surface of the cover are not to be printed.

4. The information processing apparatus according to claim 1, wherein the selection enabling means enables selection of booklet printing if the determining means determines that booklet printing is possible with the printing apparatus, and, when booklet printing is selected, enables selection of printing the cover of the booklet.

5. The information processing apparatus according to claim 1, further comprising:

comparing means for comparing setting information of the first paper feed and the second paper feed with the printing apparatus information acquired by the acquiring means; and notifying means for notifying a user that the second paper feed setting is not enabled if the result of the comparison performed by the comparing means indicates that the booklet cover cannot be printed.

6. The information processing apparatus according to claim 5, further comprising cancellation means for canceling the second paper feed setting if the result of the comparison performed by the comparing means indicates that the booklet cover cannot be printed using the second paper feed setting.

7. The information processing apparatus according to claim 1, wherein the information acquired by the acquiring means includes whether the printing apparatus is capable of double-sided printing and a size and orientation of the sheets contained in the paper feeds.

8. A printing control method for an information processing apparatus connected and capable of transmitting print data to a printing apparatus having a plurality of paper feeds, the method comprising the steps of:

acquiring information from the printing apparatus;

determining whether a cover of a booklet can be printed by the printing apparatus, based on the information obtained in the acquiring step;

enabling selection of one of a first paper feed containing page sheets for printing a desired text thereon and a second paper feed containing cover sheets for printing the cover of the booklet if the determining means determines that the cover of the booklet can be printed by the printing apparatus; and generating print data linked to the paper feeds.

9. The printing control method according to claim 8, wherein the selection enabling step further enables selection of whether to print at least one of a front surface of the cover and a back surface of the cover.

10. The printing control method according to claim 9, further comprising a blank page generating step of generating a blank page in lieu of printing the print data of at least one of the front surface of the cover and the back surface of the cover if at least one of the front surface of the cover and the back surface of the cover are not to be printed.

11. The printing control method according to claim 8, wherein the selection enabling step enables selection of booklet printing if it is determined in the determining step that booklet printing is possible with the printing apparatus, and, when booklet printing is selected, enables selection of printing the cover of the booklet.

12. The printing control method according to claim 8, further comprising the steps of:

comparing setting information of the first paper feed and the second paper feed with the printing apparatus information acquired in the acquiring step; and notifying a user that the second paper feed setting is not enabled if the result of the comparison performed in the comparing step indicates that the booklet cover cannot be printed.

13. The printing control method according to claim 12, further comprising a step of canceling the second paper feed setting if the result of the comparison performed in the comparing step indicates that the booklet cover cannot be printed using the second paper feed setting.

14. The printing control method according to claim 8, wherein the information acquired in the acquiring step includes whether the printing apparatus is capable of double-sided printing and a size and orientation of the sheets contained in the paper feeds.

15. A program for causing a computer to perform printing control of an information processing apparatus connected and capable of transmitting print data to a printing apparatus having a plurality of paper feeds, the program comprising control sequences for executing the steps of:

acquiring information from the printing apparatus;

determining whether a cover of a booklet can be printed by the printing apparatus, based on the information obtained in the acquiring step;

enabling selection of one of a first paper feed containing page sheets for printing a desired text thereon and a second paper feed containing cover sheets for printing the cover of the booklet if the determining means determines that the cover of the booklet can be printed by the printing apparatus; and generating print data linked to the paper feeds.

16. The program according to claim 15, wherein the selection enabling step further enables selection of whether to print at least one of a front surface of the cover and a back surface of the cover.

17. The program according to claim 6, further comprising a control sequence for generating a blank page in lieu of printing the print data of at least one of the front surface of the cover and the back surface of the cover if at least one of the front surface of the cover and the back surface of the cover are not to be printed.

18. The program according to claim 15, wherein the selection enabling step enables selection of booklet printing if it is determined in the determining step that booklet printing is possible with the printing apparatus, and, when booklet printing is selected, enables selection of printing the cover of the booklet.

19. The program according to claim 15, further comprising control sequences for executing the steps of:

comparing setting information of the first paper feed and the second paper feed with the printing apparatus information acquired in the acquiring step; and notifying a user that the second paper feed setting is not enabled if the result of the comparison performed in the comparing step indicates that the booklet cover cannot be printed.

20. The program according to claim 19, fturther comprising control sequences for canceling the second paper feed setting if the result of the comparison performed in the comparing step indicates that the booklet cover cannot be printed using the second paper feed setting.

21. The program according to claim 15, wherein the information acquired in the acquiring step includes whether the printing apparatus is capable of double-sided printing and a size and orientation of the sheets contained in the paper feeds.

22. A computer-readable storage medium storing a program for causing a computer to perform printing control of an information processing apparatus connected and capable of transmitting print data to a printing apparatus having a plurality of paper feeds, the program comprising control sequences for executing the steps of:

acquiring information from the printing apparatus;

determining whether a cover of a booklet can be printed by the printing apparatus, based on the information obtained by the acquiring means;

enabling selection of one of a first paper feed containing page sheets for printing a desired text thereon and a second paper feed containing cover sheets for printing the cover of the booklet if the determining means determines that the cover of the booklet can be printed by the printing apparatus; and generating print data linked to the paper feeds.

23. A display control apparatus for controlling a screen display for selecting print settings of a printing apparatus having a plurality of paper feeds, the display control apparatus comprising:

a first screen for displaying a plurality of print formats including booklet printing and for processing a selection of a print format from among the plurality of print formats; and a second screen for processing a selection of a paper feed containing desired sheets, wherein, if booklet printing is selected as the print format on the first screen, the second screen displays an item that enables selection of the paper feed for a cover of the booklet and an item that enables selection of the paper feed for the pages of the booklet, and wherein the second screen processes a selection of one of the items and displays the selected item.

24. The display control apparatus according to claim 23, wherein the second screen further displays settings for selecting whether to print at least one of a front surface of the cover and a back surface of the cover.

25. The display control apparatus according to claim 23, further comprising a screen for displaying an error if the paper feeds selected for the cover and the text of the booklet selected at the second screen do not match attributes of the paper feeds of the printing apparatus.

26. The display control apparatus according to claim 23, wherein the first screen and the second screen return to preselection states if the paper feeds selected for the cover and the text of the booklet selected at the second screen do not match the attributes of the paper feeds of the printing apparatus.

27. A display control method for controlling setting a screen display for selecting print settings in a printing apparatus having a plurality of paper feeds, the display control method comprising the steps of:

displaying, on a first screen, a plurality of print formats including booklet printing and for processing a selection of a print format from among the plurality of print formats; and providing a second screen for processing a selection of a paper feed containing desired sheets, wherein, if booklet printing is selected as the print format on the first screen, the second screen displays an item that enables selection of the paper feed for a cover of the booklet and an item that enables selection of the paper feed for the pages of the booklet, and wherein the second screen processes a selection of one of the items and displays the selected item.

28. The display control method according to claim 27, wherein the second screen further displays settings for selecting whether to print at least one of a front surface of the cover and a back surface of the cover.

29. The display control method according to claim 27, further comprising a screen for displaying an error if the paper feeds selected for the cover and the text of the booklet selected at the second screen do not match attributes of the paper feeds of the printing apparatus.

30. The display control method according to claim 27, wherein the first screen and the second screen return to preselection states if the paper feeds selected for the cover and the text of the booklet selected at the second screen do not match the attributes of the paper feeds of the printing apparatus.

31. A program for causing a computer to perform display control for controlling setting a screen display for setting print settings in a printing apparatus having a plurality of paper feeds, the program comprising control sequences for executing the steps of:

displaying, on a first screen, a plurality of print formats including booklet printing and for processing a selection of a print format from among the plurality of print formats; and providing a second screen for processing a selection of a paper feed containing desired sheets, wherein, if booklet printing is selected as the print format on the first screen, the second screen displays an item that enables selection of the paper feed for a cover of the booklet and an item that enables selection of the paper feed for the pages of the booklet, and wherein the second screen processes a selection of one of the items and displays the selected item.

32. The program according to claim 31, wherein the second screen further displays settings for selecting whether to print at least one of a front surface of the cover and a back surface of the cover.

33. The display control apparatus according to claim 31, further comprising a screen for displaying an error if the paper feeds selected for the cover and the text of the booklet selected at the second screen do not match attributes of the paper feeds of the printing apparatus.

34. The display control apparatus according to claim 31, wherein the first screen and the second screen return to preselection states if the paper feeds selected for the cover and the text of the booklet selected at the second screen do not match the attributes of the paper feeds of the printing apparatus.

35. A computer-readable storage medium storing a program for causing a computer to perform display control for controlling setting a screen display for setting print settings in a printing apparatus having a plurality of paper feeds, the program comprising control sequences for executing the steps of:

displaying, on a first screen, a plurality of print formats including booklet printing and for processing a selection of a print format from among the plurality of print formats; and providing a second screen for processing a selection of a paper feed containing desired sheets, wherein, if booklet printing is selected as the print format on the first screen, the second screen displays an item that enables selection of the paper feed for a cover of the booklet and an item that enables selection of the paper feed for the pages of the booklet, and wherein the second screen processes a selection of one of the items and displays the selected item.

36. An information processing apparatus connected and capable of transmitting print data to a printing apparatus having a plurality of paper feeds, the information processing apparatus comprising:

selection enabling means for enabling selection of whether to print at least one of a front surface of a cover and a back surface of a cover; and insertion means for inserting data that generates a blank page, when the printing is performed, at a location corresponding to the print data of the front surface of the cover and the back surface of the cover if at least one of the front surface of the cover and the back surface of the cover is not to be printed.

37. A printing control method for an information processing apparatus connected and capable of transmitting print data to a printing apparatus having a plurality of paper feeds, the method comprising the steps of:

enabling selection of whether to print at least one of a front surface and a back surface of the cover if cover printing is selected; and inserting data that generates a blank page, when the printing is performed, at a location corresponding to the print data of the front surface of the cover and the back surface of the cover if at least one of the front surface of the cover and the back surface of the cover is not to be printed.

38. A program for causing a computer to perform printing control of an information processing apparatus connected and capable of transmitting print data to a printing apparatus having a plurality of paper feeds, the program comprising control sequences for executing the steps of:

enabling selection of whether to print at least one of a front surface and a back surface of the cover if cover printing is selected; and inserting data that generates a blank page, when the printing is performed, at a location corresponding to the print data of the front surface of the cover and the back surface of the cover if at least one of the front surface of the cover and the back surface of the cover is not to be printed.

39. A computer-readable storage medium storing a program for causing a computer to perform printing control of an information processing apparatus connected and capable of transmitting print data to a printing apparatus having a plurality of paper feeds, the program comprising control sequences for executing the steps of:

enabling selection of whether to print at least one of a front surface and a back surface of the cover if cover printing is selected; and inserting data that generates a blank page, when the printing is performed, at a location corresponding to the print data of the front surface of the cover and the back surface of the cover if at least one of the front surface of the cover and the back surface of the cover is not to be printed.

* * * * *

UNITED STATES PATENT AND TRADEMARK OFFICE

CERTIFICATE OF CORRECTION

PATENT NO. : 6,632,035 B1
DATED : October 14, 2003
INVENTOR(S) : Hirokazu Kawamoto It is certified that error appears in the above-identified patent and that said Letters Patent is hereby corrected as shown below:

Column 1,
Line 59, “printing, comprises” to -- printing comprises --.

Column 2,
Lines 8 and 18, “printing,” should read -- printing --; and
Line 67, “embodiment,” should read -- embodiment; --.

Column 13,
Line 1, “claim 6” should read -- claim 16 --.
Line 22, “fturther” should read -- further --.

Column 15,
Line 5, “display control apparatus” should read -- program --.
Line 10, “display control apparatus” should read -- program --.

Signed and Sealed this

Fifteenth Day of June, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,632,035 B1
DATED : October 14, 2003
INVENTOR(S) : Hirokazu Kawamoto It is certified that error appears in the above-identified patent and that said Letters Patent is hereby corrected as shown below:

Column 12,
Lines 8 and 59, “determining means” should read -- determining step --.

Column 13,
Line 41, “acquiring means” should read -- acquiring step --; and
Line 45, “determining means” should read -- determining step --.

Signed and Sealed this

Twenty-fifth Day of October, 2005

JON W. DUDAS
*Director of the United States Patent and Trademark Office*